US006112722A

United States Patent [19]

Barnhart et al.

[11] Patent Number: 6,112,722

[45] Date of Patent: Sep. 5, 2000

[54] FUEL INJECTOR SEAT ASSEMBLY WITH POSITIVE CONTACT SEAL BETWEEN FUEL INJECTOR SLEEVE AND CYLINDER HEAD

[75] Inventors: Brett I. Barnhart, Franklin; Timothy D. Britt, Columbus; James D. Curtis, Westport; Matthew G. Leddy, Columbus; Jay F. Leonard, Columbus; David H. Parsons, Columbus; Terrence M. Shaw, Columbus; William R. Storkman, Columbus, all of Ind.

[73] Assignee: Cummins Engine, Co., Columbus, Ind.

[21] Appl. No.: 09/099,845

[22] Filed: Jun. 19, 1998

[51] Int. Cl.[7] ..... F02M 55/02

[52] U.S. Cl. ..... 123/470; 123/41.31

[58] Field of Search ..... 123/470, 41.31, 123/541, 469, 468, 495, 509

[56] References Cited

U.S. PATENT DOCUMENTS

| | | | |
|---|---|---|---|
| 2,234,780 | 3/1941 | Rippingille | 123/41.31 |
| 2,777,431 | 1/1957 | Meurer | 123/470 |
| 3,125,078 | 3/1964 | Reiners . | |
| 3,334,617 | 8/1967 | Palkowsky . | |
| 3,845,748 | 11/1974 | Eisenberg . | |
| 4,066,213 | 1/1978 | Stampe . | |
| 4,246,877 | 1/1981 | Kennedy . | |
| 5,345,913 | 9/1994 | Belshaw et al. . | |
| 5,878,719 | 3/1999 | Nakagomi | 123/470 |

FOREIGN PATENT DOCUMENTS

| | | | |
|---|---|---|---|
| 204195 | 3/1955 | Australia | 123/470 |
| 343708 | 2/1960 | Switzerland | 123/541 |
| 299635 | 11/1928 | United Kingdom | 123/541 |
| 2066895 | 7/1981 | United Kingdom | 123/470 |

*Primary Examiner*—Carl S. Miller
*Attorney, Agent, or Firm*—Leydig, Voit & Mayer

[57] ABSTRACT

An assembly including an engine component, such as a fuel injector, seated against a seating surface of a cylinder head is provided with a positive seal contact an uppermost point of contact between an injector sleeve and a seating surface of the cylinder head. The positive seal contact prevents coolant from the water jacket from travelling below the uppermost point of contact, thereby avoiding cavitation damage which might otherwise occur by the entrapment of liquid between the cylinder head seating surface and the injector sleeve. In an embodiment, a raised annular ridge is formed in the seating surface of the cylinder head at the location of the uppermost point of contact. This ridge becomes embedded in the injector sleeve. Also, in an embodiment, the cylinder head includes a circular recess upwardly from the uppermost point of contact. Although coolant from the water jacket can enter the recess, the recess radially separates the cylinder head from the injector sleeve by an amount that will not be closed under deflection due to cyclic loading on the injector.

22 Claims, 2 Drawing Sheets

FUEL INJECTOR SEAT ASSEMBLY WITH POSITIVE CONTACT SEAL BETWEEN FUEL INJECTOR SLEEVE AND CYLINDER HEAD

BACKGROUND OF THE INVENTION

The present invention generally relates to engines and more particularly relates to a seating contact between a component, such as an injector sleeve, and a cylinder head.

In an engine, certain components are mounted to a cylinder head above a combustion chamber. For example, in a fuel-injected engine, fuel injectors are seated against a cylinder head of the engine at desired locations for injecting fuel into the cylinders below. More particularly, known fuel injectors have an outer casing known as an injector sleeve that contact directly against a generally mated seating surface formed in the cylinder head. The seating surface is generally cooperatively shaped with the injector sleeve, e.g., frustoconical shaped. It is known to provide one or more raised annular ridges in the seating surface to cause a positive seal contact between the cylinder head and the injector sleeve, but these ridges have previously been located at a vertical midpoint of the sealing surface, substantially below an uppermost point of contact between the injector sleeve and the seating surface.

An upper end of the seating area is exposed to a water jacket of the engine. In the conventional system, a narrow crevice can form between the injector sleeve and an upper portion of the seating area. This crevice can be due to the static geometry of the seated structures, or the crevice can be caused by deflection during load cycling of components which are normally flushly seated in a static condition. Unfortunately, liquid coolant is drawn into the crevice and then forced out at high velocity or compressed during injector loading, causing cavitation damage, fatigue, and ultimately component failure.

Other components are known which have similar mounting structures. For example, a spark plug in a natural gas engine is known which has a seating geometry similar to that of the above-described fuel injector.

A need exists for an improved cylinder head seat assembly for a component, such as a fuel injector, spark plug and the like, which reduces cavitation damage.

SUMMARY OF THE INVENTION

The invention provides an improved seat structure for a fuel injector, spark plug or other component mounted in communication above a combustion chamber. In particular, the structure of the invention reduces cavitation damage by ensuring that a positive seal exists between an uppermost contact point between an outer surface of the component, such as an injector sleeve, and the cylinder head seating surface. Although the uppermost point of contact is adjacently exposed to the water jacket, the positive seal at this location prevents the entry of coolant fluid between the sleeve and seating surface.

More particularly, an embodiment of the invention provides an injector assembly for an engine including (a) an injector sleeve; and (b) a cylinder head having a seating surface cooperatively shaped to support a tapered portion of the injector sleeve directly thereon. An upper end of the seating surface is adjacent to a water jacket of the engine, and the seating surface extends downwardly toward a combustion chamber. According to the invention, an uppermost point of contact between the sleeve and cylinder head forms a positive seal between the sleeve and cylinder head seating surface.

In an embodiment, the seating surface includes a step-like annular ridge at the uppermost point of contact. The ridge provides a high-force line of contact against the sleeve and may become embedded in the sleeve, thereby assuring the positive seal. In an embodiment, the seating surface includes at least one additional annular ridge spaced below the uppermost point of contact.

In an embodiment, a recess is formed in the cylinder head upwardly from the uppermost point of contact. More specifically, the recess is formed upwardly adjacent to the ridge, radially separating the cylinder head from the sleeve upwardly from the uppermost point of contact. In a preferred geometry of the recess, a bottom of the recess extends radially away from the uppermost point of contact in a generally horizontal direction. A sloping side of the recess leads from the radial bottom up to a main portion of the water jacket. In any case, the recess has a volume that is sufficient in size such that volumetric changes of the recess due to cyclic loading will not result in high-velocity flow from the recess that could cause cavitation damage.

An advantage of the present invention is that it provides an improved injector assembly.

Another advantage of the present invention is that it provides an injector seat assembly that reduces cavitation damage.

A further advantage of the present invention is that it provides an injector seat assembly that forms a positive seal contact directly between the injector sleeve and a cooperatively shaped seating surface formed in the cylinder head.

Additional features and advantages of the present invention are described in, and will be apparent from, the detailed description of the embodiments, the Figures, and the claims.

DETAILED DESCRIPTION OF THE PREFERRED EMBODIMENTS

Figure 1:
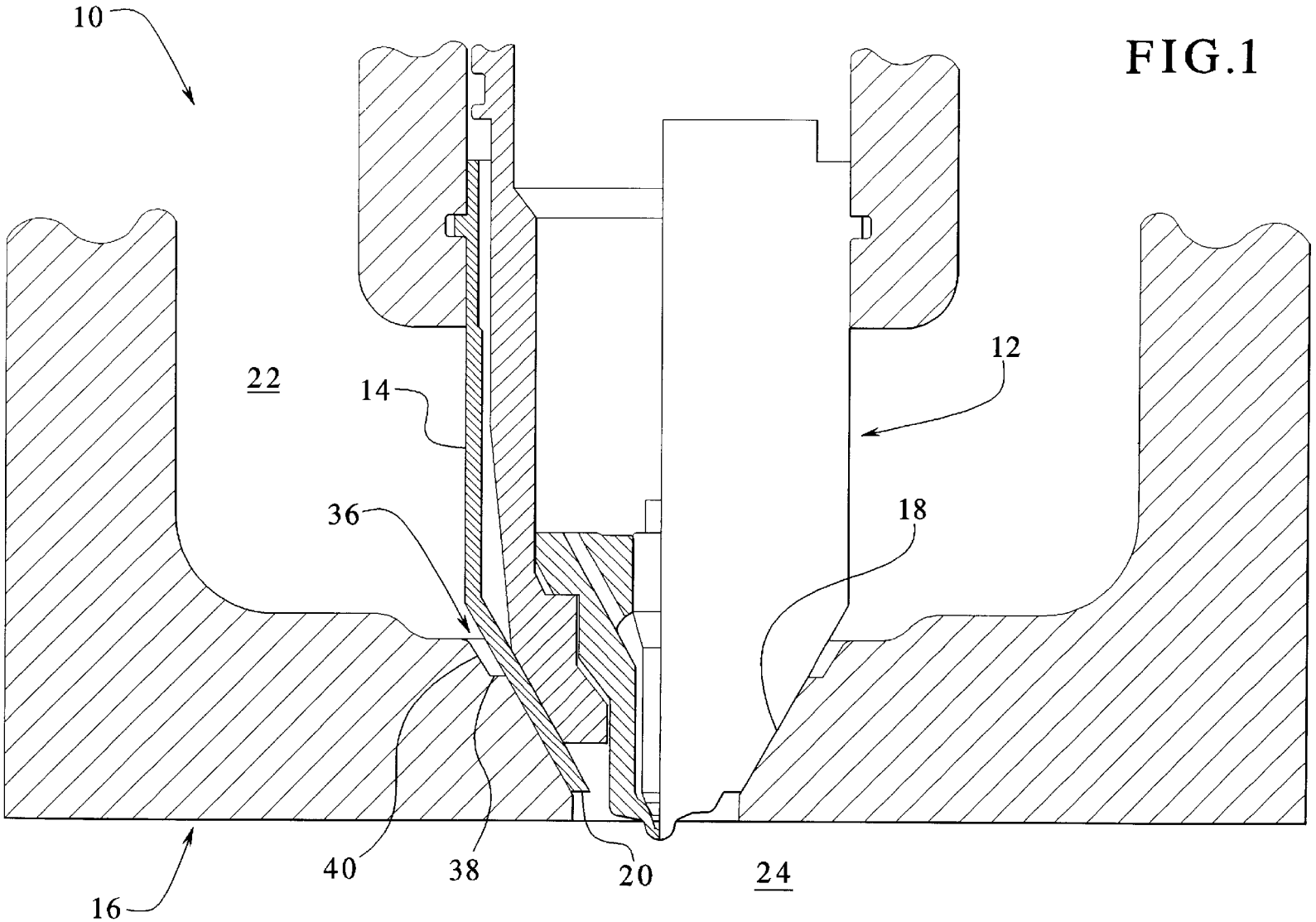
FIG. 1 is a fragmentary side sectional view of a component seating assembly embodying features according to the present invention.

Now referring to the Figures, wherein like numerals designate like parts, FIG. 1 illustrates an injector assembly 10 in an engine. The assembly 10 includes an engine component such as an injector 12 having an injector sleeve 14 and a cylinder head 16 against which the injector sleeve 16 is cooperatively seated. The cylinder head 16 has a seating surface 18 that is shaped to receive a generally frustoconical tip 20 of the injector sleeve 14.

In general, a water jacket 22 is disposed upwardly from the cylinder head 16, surrounding an exposed portion of the injector sleeve 14. A combustion chamber 24 is disposed generally below the cylinder head 16.

It is noted that although the disclosure herein particularly refers to the injector 12, the invention can be applied to other engine components as well. For example, the component referred to the injector 12 could be some other structure which is similarly seated on the cylinder head 16 for communication with the combustion chamber 16. One such component could be a spark plug of a type used in natural gas engines. It should be understood that element number 12 can represent any component which has a seat geometry such as that disclosed herein. The element referred to herein as sleeve 14 may be the outer surface of any such component.

Figure 2:
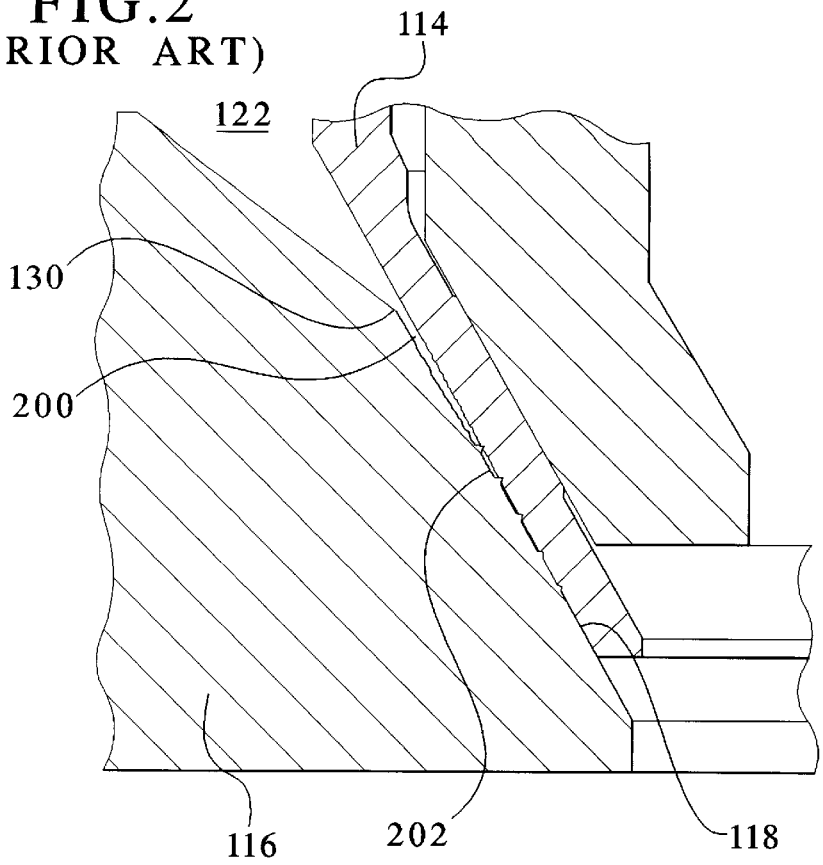
FIG.2 (PRIOR ART)
FIG. 2 is a fragmentary side sectional view of a prior art fuel injector assembly wherein the uppermost point of contact between the cylinder head seating surface and the injector has become separated from each other to form a crevice.

Turning to FIG. 2, a conventional injector assembly is illustrated having a conventional seating contact between an injector sleeve 114 and a conventional cylinder head 116. The sleeve 114 tends to undesirably move relative to the seating surface 118 during operation. In particular, the injector sleeve 114 is subjected to high cyclic loads, resulting in a flexing of the sleeve 114 and a separation of an uppermost point of contact 130 between the sleeve 114 and the seating surface 118. This flexing forms a crevice 200 as illustrated in FIG. 2. The crevice 200 can also exist due to a non-flush static seating geometry of the sleeve 114 and the seating surface 118.

The uppermost point of contact 130 between the sleeve 114 and the conventional seating surface 118 are not always in contact with each other, and thus the conventional assembly does not include a positive seal contact at the point 130. The relative movement of the sleeve 114 along the seating surface 118 results in cavitation damage to these components which worsens over time. Specifically, a water jacket 122 is disposed upwardly of the cylinder head 116. Liquid coolant from the water jacket 122 enters the crevice 200 when the crevice 200 is open. When the injector sleeve 114 is then loaded such that the crevice 200 decreases in volume, coolant and bubbles in the crevice 200 become highly pressurized, exiting the crevice 200 at high flow velocities and resulting in erosion of metal. This cavitation damage is exhibited by the formation of pits 202 in the seating surface 118 and injector sleeve 114 in the crevice 200.

According to the present invention, a positive seal contact is formed at an uppermost point of contact between the injector sleeve and the seating surface of the cylinder head. The positive seal contact prevents the periodic formation of a crevice below that location as has problematically occurred in prior art injector assemblies. In an embodiment, the seating surface includes a step-like annular ridge at the uppermost point of contact, ensuring the positive seal contact at that location. Also, in an embodiment, the cylinder head includes a recess adjacent the ridge. The recess forms a radial separation between the cylinder head and the sleeve upwardly from the uppermost point of contact.

Figure 3:
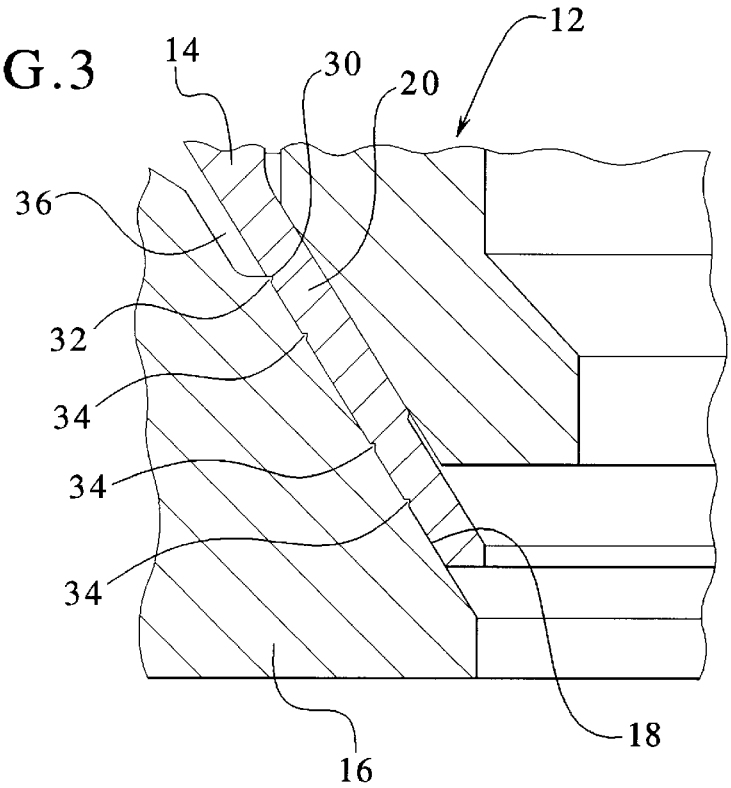
FIG. 3 is an enlarged fragmentary side sectional view of the component seating assembly of FIG. 1 wherein an uppermost point of contact between the sleeve and cylinder head forms a positive seal between the sleeve and cylinder head seating surface.

More particularly, FIG. 3 is an enlarged view of the injector assembly of FIG. 1, showing the seating contact between the injector sleeve 14 and the cylinder head seating surface 18 in greater detail. As illustrated, the seating surface 18 is cooperatively shaped to directly receive and support the frustoconical tip 20 of the injector sleeve 14. According to the invention, an uppermost point of contact 30 between the injector sleeve 14 and the seating surface 18 is a positive seal contact.

In an embodiment, the seating surface 18 includes a step-like raised annular ridge 32 located at the uppermost point of contact 30. This ridge 32 becomes embedded in the injector sleeve 14, forming a reliable positive sealed contact that resists movement or separation of the sleeve relative to the cylinder head. Thereby, coolant from the water jacket 22 is prevented from travelling between the seating surface 18 the adjacent portion of the tip 20 of the injector sleeve 14. One or more additional raised annular ridge 34 may be provided in the seating surface 18 at locations lower than the uppermost point of contact 30.

In the embodiment illustrated in FIG. 3, each of the step-shaped ridges 32, 34 has an horizontal surface which axially supports the injector sleeve 14. Also, each of the ridges 32, 34 has an axially-oriented vertical surface of the injector that sealably engages the injector sleeve 14.

In an embodiment, the cylinder head 16 includes a circular recess 36 which forms a radial separation of the cylinder head 16 from the injector sleeve 14. The recess 36 is located upwardly of the uppermost point of contact 30 and opens upwardly to the waterjacket 22. The recess 36 has a radial dimension large enough to avoid cavitation damage. Accordingly, the recess 36 forms is substantially larger separation between the sleeve and cylinder head than the crevice 200 (FIG. 2) formed in prior art structures. More particularly, the recess 36 has a volume sufficiently large that any volumetric change of the recess due to deflection of the sleeve 14 due to normal cyclic loading on the injector 12 or cylinder pressure will not result in high-velocity flow to and from the recess 36 that could cause cavitation damage. Additionally, the recess 36 will not close during cyclic deflection.

The recess 36 is formed in the cylinder head upwardly from the uppermost point of contact 30. More specifically, the recess is formed upwardly adjacent to the ridge 32, radially separating the cylinder head 16 from the sleeve 14 upwardly from the uppermost point of contact 30. Preferably the recess 36 is shaped to have a bottom surface 38 that extends radially away for a distance from the uppermost point of contact 30 generally horizontally (relative to the orientation of FIGS. 1 and 3). A sloping side 40 of the recess 36 leads upwardly from the radial bottom 38 up to a main portion of the water jacket 22 (FIG. 1). The recess 36 may be provided in other shapes as well which provide a volume sufficiently large such that volumetric changes of the recess due to cyclic loading will avoid high-velocity flow from the recess.

In an embodiment, it has been found that the recess 36 yields suitable performance wherein it provides a separation of about 0.025 inches between the sleeve 14 and the surface 40 of the recess. This dimension has been found especially suitable wherein the bottom 38 of the recess and uppermost point of contact 30 are located at about 0.470 inches from a top of the combustion chamber 24. Of course, other dimensions may be found suitable in particular applications.

The present invention is not limited to the exemplary embodiments specifically described herein. To the contrary, it is recognized that various changes and modifications to the embodiments specifically described herein would be apparent to those skilled in the art, and that such changes and modifications may be made without departing from the spirit and scope of the present invention. Accordingly, the appended claims are intended to cover such changes and modifications as well.

What is claimed is:

1. An assembly comprising: a cylinder head; and a component seated against the cylinder head for communication through a bore in the cylinder head to a combustion chamber, the cylinder head having a seating surface formed which is generally cooperatively-shaped to receive a tapered portion of the component directly thereon, an upper end of the seating surface being located adjacent a water jacket, wherein an uppermost point of contact between the component and cylinder head forms a positive seal between the component and cylinder head seating surface, wherein said seating surface includes a step-like annular ridge at said uppermost point of contact.

2. An injector assembly according to claim 1, wherein the seating surface includes at least one additional annular ridge spaced below said uppermost point of contact.

3. An assembly according to claim 1, wherein the tapered portion of the component and the generally cooperatively-shaped seating surface are generally frustoconical.

4. An assembly according to claim 1, further comprising a recess in the cylinder head adjacent the ridge the forming a radial separation between the cylinder head and the component upwardly from said uppermost point of contact.

5. An assembly according to claim 4, wherein said recess has a bottom surface that extends radially away for a distance from said uppermost point of contact generally horizontally.

6. An assembly according to claim 5, wherein said recess further includes a sloping side that extends upwardly from said bottom surface to the water jacket.

7. An assembly according to claim 4, wherein said recess has a volume such that volumetric changes of the recess due to cyclic loading will avoid velocity flow rates of fluid from the recess high enough to result in cavitation damage.

8. An assembly according to claim 1, wherein said component is a fuel injector sleeve.

9. A cylinder head for a fuel-injected engine comprising a metal body and a bore extending through the body, the bore forming a generally frustoconical seating surface to support a generally frustoconical portion of an injector sleeve directly thereon, an upper end of the seating surface being located adjacent to a water jacket, an uppermost point of the seating surface including a raised annular ridge formed thereon.

10. A cylinder head according to claim 9, wherein the ridge is operable to form a positive seal between the seating surface and an injector sleeve supported thereon.

11. A cylinder head according to claim 10, further comprising an annular recess formed in the metal body extending radially outwardly from said seating surface adjacent said uppermost point of the seating surface and extending upwardly to form a volume between the metal body and the sleeve upwardly from said uppermost point.

12. An assembly according to claim 11, wherein said volume of the recess such that volumetric changes of the recess due to cyclic loading will avoid velocity flow rates of fluid from the recess high enough to result in cavitation damage.

13. A cylinder head according to claim 11, wherein at least one additional raised annular ridge is formed in said seating surface spaced downwardly from said uppermost point.

14. An engine comprising:

an injector sleeve; and a cylinder head having a generally frustoconical seating surface formed therein to cooperatively receive a portion of the injector sleeve directly thereon, the seating surface having a raised annular ridge extending around the seating surface at a point of greatest diameter of the seating surface.

15. An engine according to claim 14, wherein said annular ridge forms a positive seal contact between the sleeve and the cylinder head.

16. An engine according to claim 14, wherein a circular recess is formed in said cylinder head forming a separation between the cylinder head and the sleeve upwardly from said ridge.

17. An engine according to claim 16, wherein said separation is about 0.025 inches.

18. An assembly according to claim 16, wherein said recess has a volume sufficiently large such that changes in volume due to cyclic loading will not result in velocity flow rates of fluid from the recess high enough to result in cavitation damage.

19. An engine according to claim 14, wherein said seating surface includes at least one additional annular ridge spaced from said point of greatest diameter.

20. An assembly according to claim 1, wherein said step-like annular ridge includes a first circular surface substantially parallel to a central axis of the component and a second circular surface that is substantially planar and perpendicular to the axis.

21. A cylinder head according to claim 10, wherein said raised annular ridge includes a first circular surface substantially parallel to a central axis of the injector sleeve and a second circular surface that is substantially planar and perpendicular to said axis.

22. An engine according to claim 14, wherein said raised annular ridge includes a first circular surface substantially parallel to an axis and a second circular surface that is substantially planar and perpendicular to said axis.

* * * * *